US009492006B2

(12) United States Patent
Jimenez et al.

(10) Patent No.: US 9,492,006 B2
(45) Date of Patent: Nov. 15, 2016

(54) ORAL CARE KIT AND PACKAGE FOR SAME

(71) Applicant: COLGATE-PALMOLIVE COMPANY, New York, NY (US)

(72) Inventors: Eduardo Jimenez, Manalapan, NJ (US); Robert Moskovich, East Brunswick, NJ (US); Michael Rooney, Millburn, NJ (US); David Lee, New Brunswick, NJ (US); Frank Horn, Wayne, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/443,605

(22) PCT Filed: Nov. 19, 2012

(86) PCT No.: PCT/US2012/065792
§ 371 (c)(1),
(2) Date: May 18, 2015

(87) PCT Pub. No.: WO2014/077845
PCT Pub. Date: May 22, 2014

(65) Prior Publication Data

US 2015/0282603 A1 Oct. 8, 2015

(51) Int. Cl.
*B65D 75/24* (2006.01)
*A46B 15/00* (2006.01)
(Continued)

(52) U.S. Cl.
CPC ..... *A46B 15/0091* (2013.01); *A46B 11/001* (2013.01); *A46B 11/0027* (2013.01);
(Continued)

(58) Field of Classification Search
CPC ... A46B 11/001; B65D 77/003; B65D 75/52
USPC ..... 206/477, 483, 361
See application file for complete search history.

(56) References Cited

U.S. PATENT DOCUMENTS 6,059,106 A 5/2000 Baker et al.
7,723,629 B2 5/2010 Chan
(Continued)

FOREIGN PATENT DOCUMENTS

CN 201784907 4/2011
CN 201856983 6/2011
(Continued)

OTHER PUBLICATIONS

International Search Report and the Written Opinion of the International Searching Authority issued in International Application PCT/US2012/065792 mailed Jun. 18, 2013.
(Continued)

*Primary Examiner* — King M Chu

(57) ABSTRACT

An oral care kit (100) is provided to allow users with the ability to view a portion of the toothbrush (400) and the dispenser (500), such as a recess located at one end of the toothbrush (400) and an anti-rotation member (560) located at one end of the dispenser (500), without opening the package (300). The oral care kit (100) includes a package (300) comprising first and second cavities (600, 700). Each cavity (600, 700) includes retaining elements (630, 640, 650, 730, 750). Additionally, the second cavity (700) includes a retaining channel (740). The oral care kit (100) also includes a toothbrush (400) comprising a head (430), a handle (410), and a recess located at a proximal end of the handle (410), and a dispenser (500) comprising a housing (520), a rotatable actuator (540) and an anti-rotation member (560) located at a proximal end of the housing (520). When the toothbrush (400) is mounted within the first cavity (600), the recess is visible and when the dispenser (500) is mounted within the second cavity (700), the anti-rotation member (560) is visible.

19 Claims, 6 Drawing Sheets

(51) Int. Cl.

| | |
|---|---|
| ***A46B 11/00*** | (2006.01) |
| ***B65D 75/36*** | (2006.01) |
| ***B65D 77/00*** | (2006.01) |

(52) U.S. Cl.

CPC ..... *A46B11/0065* (2013.01); *A46B 15/0061* (2013.01); *B65D 75/367* (2013.01); *B65D 77/003* (2013.01); *A46B 2200/1066* (2013.01)

(56) References Cited

U.S. PATENT DOCUMENTS

| | | | | |
|---|---|---|---|---|
| 2003/0089631 | A1* | 5/2003 | Petricca ..... | A45D 27/225 206/356 |
| 2003/0166373 | A1 | 9/2003 | Whitney et al. | |
| 2006/0289030 | A1 | 12/2006 | Pho | |
| 2009/0236241 | A1 | 9/2009 | Jimenez et al. | |
| 2010/0230312 | A1* | 9/2010 | Sorrentino ..... | B65D 21/0202 206/369 |
| 2011/0147241 | A1* | 6/2011 | Marcinkowski ..... | B65D 75/327 206/223 |
| 2011/0308030 | A1 | 12/2011 | Jimenez et al. | |
| 2013/0276815 | A1 | 10/2013 | Hohlbein et al. | |

FOREIGN PATENT DOCUMENTS

| | | | | |
|---|---|---|---|---|
| CN | 102448844 | | 5/2012 | |
| EP | 1506726 | | 2/2005 | |
| WO | WO 2011079030 | A1 * | 6/2011 | ..... A46B 11/0024 |

OTHER PUBLICATIONS

Written Opinion of the International Preliminary Examining Authority issued in International Application PCT/US2012/065792 mailed Oct. 27, 2014.

* cited by examiner

ORAL CARE KIT AND PACKAGE FOR SAME

CROSS-REFERENCE TO RELATED PATENT APPLICATIONS

This application is a U.S. national stage application under 35 U.S.C. §371 of PCT Application No. PCT/US2012/65792, filed Nov. 19, 2012, the entirety of which is incorporated herein by reference.

FIELD OF THE INVENTION

The present invention relates generally to the field of oral care kits, and specifically to oral care kits that include a package containing a toothbrush and a dispenser.

BACKGROUND OF THE INVENTION

In the commercialization of oral care kits, the current trend is to package multiple oral care implements and or companion oral care products in thermoform packages. Often, the oral care implement and the companion oral care product that are packaged together are intended to be used together. In certain circumstances, the oral care implement and the companion oral care product may require assembly in order to provide an added oral care benefit. In order to communicate to consumers as to how to use both products, the package may include information that are printed on the package or included in an instruction slip that is included in the package. While printed information and instruction slip are helpful in relaying product information to the consumer, it would be useful and desirable to provide a package for an oral care kits that includes an oral care implement and a companion oral care product that provides visual cues to the consumers as to how both products are to be assembled together if assembly is required.

BRIEF SUMMARY OF THE INVENTION

In one embodiment, the invention can be an oral care kit comprising: a package comprising a first cavity including, a first plurality of retaining elements and a second cavity including a second plurality of retaining elements and a first retaining channel, the first cavity including a top surface. The oral care kit also comprises a toothbrush comprising a head, a handle, and a recess located at a proximal end of the handle, the toothbrush positioned within the first cavity, a portion of the toothbrush contacting the first plurality of retaining elements. The oral care kit further comprises a dispenser comprising an anti-rotation member located at a proximal end of the dispenser, the dispenser positioned within the second cavity, a first portion of the dispenser contacting the second plurality of retaining elements and a second portion of the dispenser contacting the first retaining channel. Wherein, the toothbrush is mounted within the first cavity so that the recess is visible from outside of the package and the dispenser is mounted within the second cavity so that the anti-rotation member is visible from outside of the package.

In another embodiment, the invention can be a package for an oral care kit comprising: a first cavity including a top surface and an inner side surface, a first plurality of retaining elements extending from the inner side surface and the top surface, the first cavity has a shape and size that corresponds to a shape and size of a toothbrush. The package also comprising a second cavity including a top surface and an inner side surface, a second plurality of retaining elements extending from the inner side surface and a first retaining channel disposed in the top surface, the second cavity has a shape and size that corresponds to a shape and size of a dispenser. Wherein, when the toothbrush is mounted within the first cavity, the first plurality of retaining elements cooperate to orient the toothbrush so that a recess of the toothbrush is visible, and when the dispenser is mounted within the second cavity, the second plurality of retaining elements and the first retaining channel cooperate to orient the dispenser so that an anti-rotation member of the dispenser is visible, the recess and the anti-rotation member capable of forming a keyed cooperation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
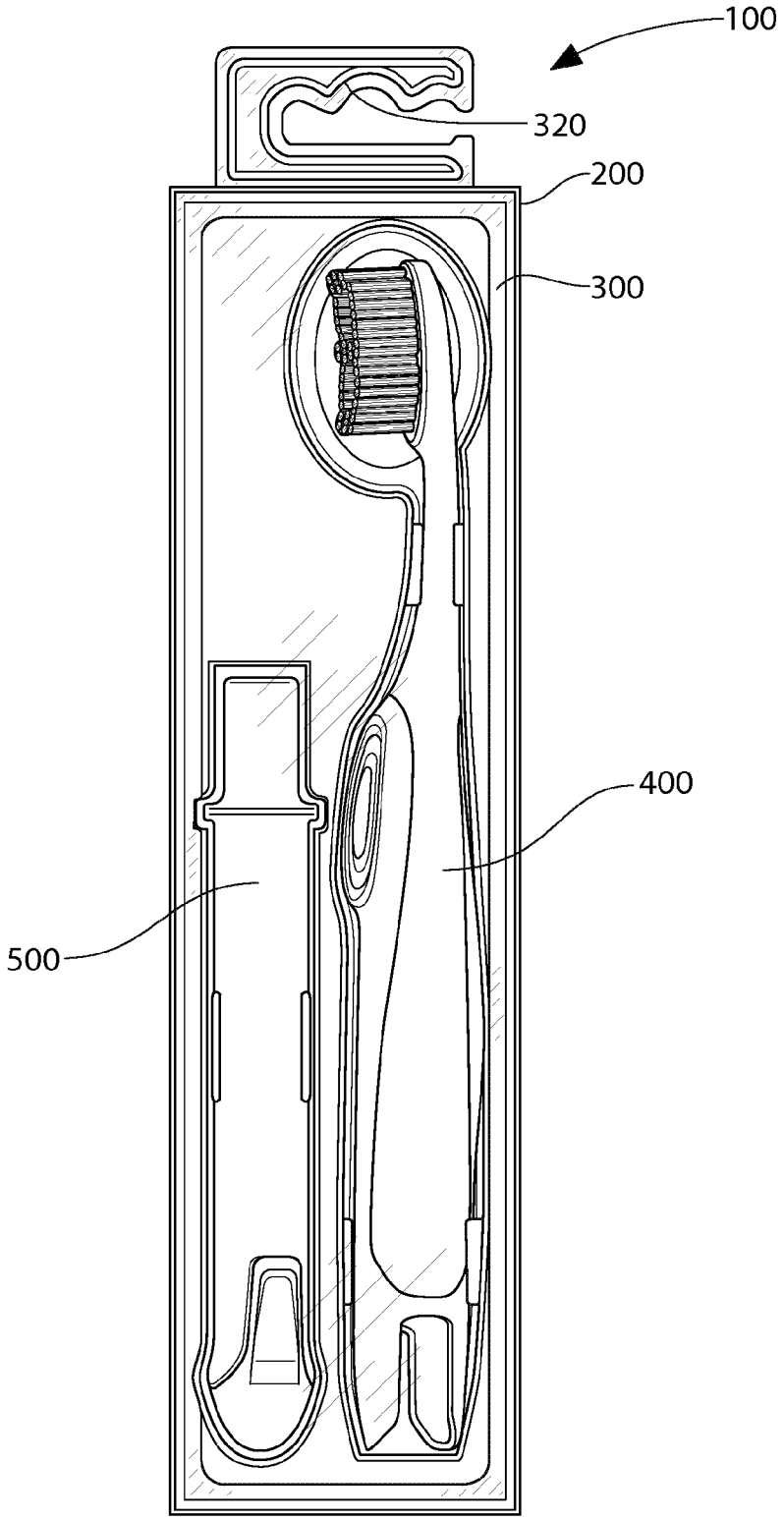
FIG. 1 is a from view of an oral care kit including a sleeve, a package, a toothbrush and a dispenser according to one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc) should be construed to refer to the orientation as then described or as shown in the drawing under discussion. These relative terms are for convenience of description only and do not require that the apparatus be constructed or operated in a particular orientation unless explicitly indicated as such. Terms such as "attached." "affixed," "connected," "coupled," "interconnected," and similar refer to a relationship wherein structures are secured or attached to one another either directly or indirectly through intervening structures, as well as both movable or rigid attachments or relationships, unless express described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIG. 1-5 concurrently, an oral care kit 100 is illustrated according to one embodiment of the present invention. The oral care kit 100 generally comprises a sleeve 200, a package 300, a toothbrush 400 and an oral care material dispenser 500, in the embodiment as shown, the oral care kit 100 also includes a hanger tab 320 that facilitates hanging, of the product in a store for display. However, it is understood that in other embodiments, the hanger tab 320 may be eliminated or the hanger tab 320 may be replaced with other means, such as a hole, to facilitate the hanging of the product for display. In the embodiment as shown in FIG. 1, the sleeve 200 may be semi-transparent or transparent such that the contents of the oral care kit 100 may be visible to the consumer at the point of sale. As used herein, the term "transparent" includes materials that allow a user to see through the material, even if the material is colored or includes a small degree of translucency. In some embodiments, a portion of the sleeve 200 may include product information, marketing information, instructions, graphics, logos, and/or other visual designs, and/or other relevant information. In some embodiments, the various information may be included on a separate insert (not shown) that is included in the oral care kit 100.

Figure 3:
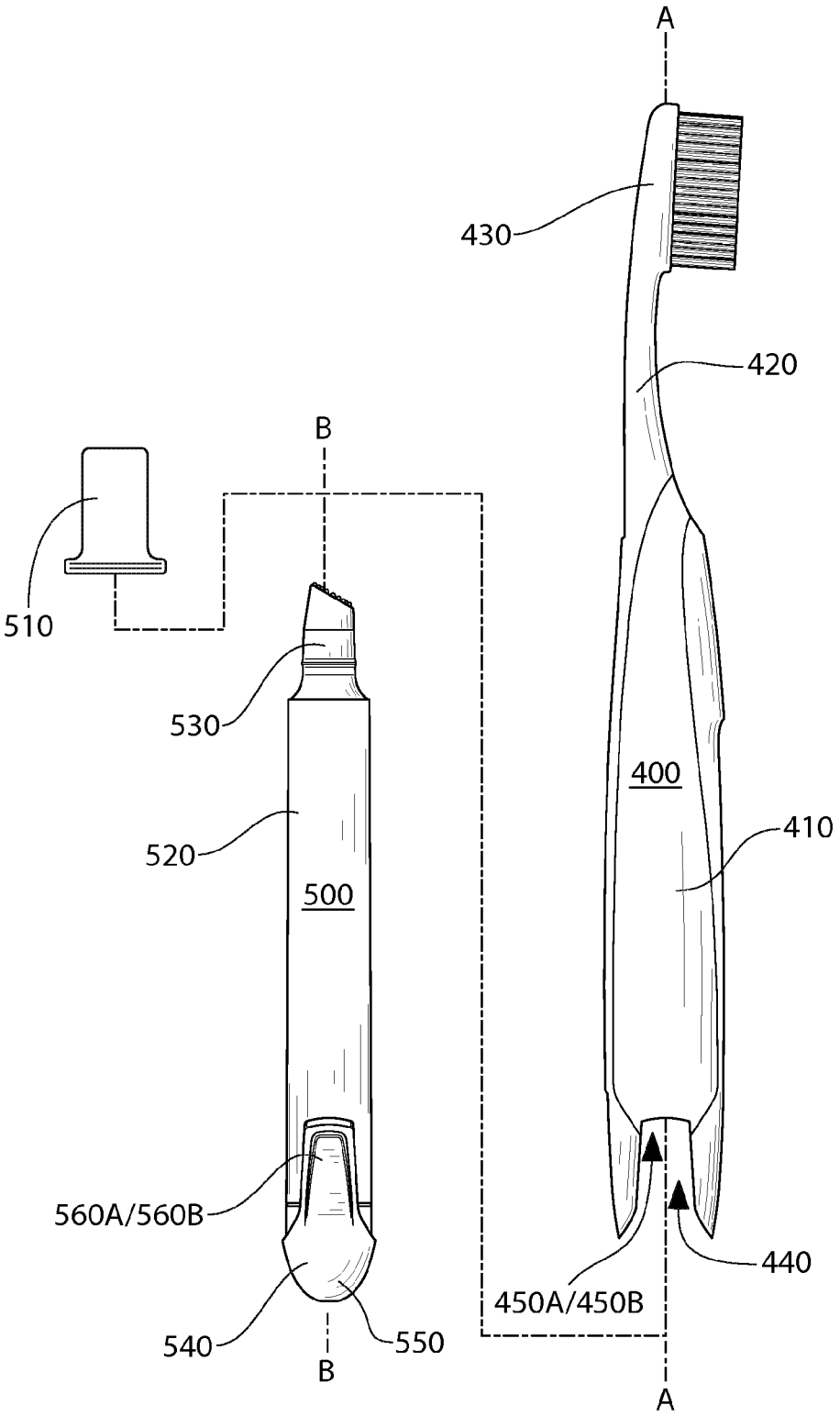
FIG. 3 is a left side view of the toothbrush and the dispenser of the oral care kit of FIG. 1 where the dispenser is separated from the toothbrush.

Referring to FIG. 3, the oral care kit 100 is a compact, readily portable, self-contained, user-friendly system that comprises all of the necessary components and chemistries necessary fir a user to perform a desired oral care treatment routine. As will be described in greater detail below, the oral care kit 100 in one exemplary embodiment comprises a modified toothbrush 400 having a removable dispenser 500 disposed at least partially within its handle 410. Because the dispenser 500 is located within the handle 410 of the toothbrush 400, the oral care kit 100 is portable for travel, easy to use, and reduces the amount of required storage space. Furthermore, since the toothbrush 400 and dispenser 500 are housed together, the user is less likely to misplace the dispenser 500 and more inclined to maintain the oral treatment routine with the dispenser 500 since brushing will remind the user to simply detach and apply the contents of the dispenser 500.

The oral care kit 100 is exemplified in conjunction with the commercialization of a toothbrush 400 and an oral care material dispenser 500. The invention, however, is not so limited. In alternate embodiments, other oral care implements can be included in the oral care kit 100 including tongue cleaners, tooth polishers, floss dispenser, tooth cleaning accessories (e.g., toothpick, interdental brushes, etc.) and other oral care ansate implements. In certain instances, the toothbrush 400 may include tooth engaging elements that are specifically designed to increase the effect of the oral care material in the dispenser on the teeth. For example, the tooth engaging elements may include elastomeric wiping, elements that assist in removing stains from teeth and/or assist with forcing the oral care material into the tubules of the teeth. Moreover, while the toothbrush 400 is exemplified as a manual toothbrush, the toothbrush 400 may be a powered toothbrush in certain embodiments of the invention. It is to be understood that the inventive system can be utilized for a variety of intended oral care needs by filling the dispenser 500 with any fluid, such as an oral care agent that achieves a desired oral effect. In one embodiment, the fluid is free of (i.e., is not) toothpaste as the dispenser 500 is intended to augment not supplant the brushing regimen. The fluid can be selected to complement a toothpaste formula, such as by coordinating flavors, colors, aesthetics, or active ingredients. In addition, embodiments of the oral care system may include without limitation the following fluids: tooth whitening, antibacterial, enamel protection, anti-sensitivity, anti-inflammatory, anti-attachment, fluoride, tartar control/protection, flavorant, sensate, colorant and others. However, other embodiments of the present invention may be used to store and dispense any suitable type of fluid and the invention is expressly not limited to any particular oral care kit or oral care material alone. In addition, while the exemplary embodiment of the package includes only two products, in other embodiments, the package may include more or less products with their respective retaining means (to be described further in details below) for positioning the products within the package.

Referring to FIG. 3, the toothbrush 400 generally comprises a handle 410, a neck 420 and a head 430. The handle 410 provides the user with a mechanism by which he/she can readily grip and manipulate the toothbrush 400. The handle 410 may be formed of many different shapes, sizes and materials and may be formed by a variety of manufacturing methods that are well-known to those skilled in the art. Preferably, the handle 410 can house the dispenser 500 therein as described in detail below. If desired, the handle 410 may include a suitable textured grip made of soft elastomeric material. The handle 410 can be a single or multi-part construction. The handle 410 extends from a proximal end to a distal end along a longitudinal axis A-A. A cavity (not shown) is formed within the handle 410. An opening 440 is provided at the proximal end of the handle 410 that provides a passageway into the cavity through which the dispenser 500 can be inserted and retracted. While the opening 440 is located at the proximal end of the handle 410 in the exemplified embodiment, the opening 440 may be located at other positions on the handle 410 in other embodiments of the invention. For example, the opening 440 may be located on a longitudinal surface of the handle 410 (e.g., the front surface, the rear surface and/or the side surfaces) and be elongated to provide sufficient access to the cavity.

The handle 410 transitions into the neck 420 at the distal end. While the neck 420 generally has a smaller transverse cross-sectional area than the handle 410, the invention is not so limited. Broadly speaking, the neck 420 is merely the transition region between the handle 410 and the head 430 and can conceptually be considered as a portion of the handle 410. In this manner, the head 430 is connected to the distal end of the handle 410 (via the neck 420).

The head 430 and the handle 410 of the toothbrush 400 are formed as a single unitary structure using a molding, milling, machining or other suitable process. However, in other embodiments, the handle 410 and head 430 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 430 and handle 410 are of a unitary or multi-piece construction (including connection techniques) is not limiting of the present invention, unless specifically claimed. In some embodiments of the invention, the head 430 may be detachable (and replaceable) from the handle 410 using techniques known in the art.

In the embodiment as shown in FIGS. 1-4, the head 430 comprises a collection of oral cleaning elements such as tooth engaging elements 450 extending therefrom for cleaning and/or polishing contact with an oral surface and/or interdental spaces. While the collection of tooth engaging elements 450 is suited for brushing teeth, the collection of tooth engaging elements 450 can also be used to polish teeth instead of or in addition to cleaning teeth. As used herein, the term "tooth engaging elements" is used in a generic sense to refer to any structure that can be used to clean, polish or wipe the teeth and/or soft oral tissue (e.g. tongue, cheek, gums, etc.) through relative surface contact. Common examples of "tooth engaging elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include, any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

In some embodiments, the head 430 may also comprise additional structures for oral cleaning or tooth engagement, such as a soft tissue cleaner or a tooth polishing structure. An example of a soft tissue cleaner is an elastomeric pad comprising a plurality of nubs and or ridges. An example of a tooth polishing structure can be an elastomeric element, such as a prophy cup(s) or elastomeric wipers. Furthermore, while the head 430 is normally widened relative to the neck. 420 of the handle 410, it could in some constructions simply be a continuous extension or narrowing of the handle 410.

The toothbrush 400 and the dispenser 500 are non-unitary separate structures that are specially designed to be detachably coupled together when in an assembled state (referred to herein as a storage state) and completely isolated and separated from one another when in a disassembled state (referred to herein as an application state). The toothbrush 400 and the dispenser 500 are illustrated in the application state in FIG. 3 and in the storage state in FIG. 4. The dispenser 500 can be slidably manipulated and altered between the storage state (FIG. 4) in which the dispenser 500 is located (or docked) in the toothbrush handle 410 and the application state (FIG. 3) in which the dispenser 500 is removed from the handle 410 by the user as desired.

Referring now to FIG. 3, an embodiment of the dispenser 500 will be described in greater detail. Generally, the dispenser 500 is an elongated tubular pen-like structure that extends along a longitudinal axis B-B. The dispenser 500 generally comprises a cap 510, a housing 520, an applicator 530 located at a distal end of the housing 520, and a rotatable actuator 540 located at a proximal end of the housing 520. In the embodiment as shown, the cap 510 is removed from the applicator 530. The dispenser 500 is designed so as to be capable of being operated to dispense the fluid stored therein using a single hand. Specifically, the dispenser 500 is positioned in a user's hand so that the rotatable actuator 540 is lodged in the palm of the user's hand. The user then uses the fingers of that same hand to rotate the housing 520 relative, to the actuator 540. As a result, the fluid contained therein is dispensed from the dispenser 500.

In the exemplified embodiment, the housing 520 has a circular transverse cross-sectional profile (shown in FIGS. 1-4). Of course, in other embodiments, the transverse cross-sectional profile of the housing 520 can take on non-circular shapes. The housing 520 is constructed of a material that is sufficiently rigid to provide the necessary structural integrity for the dispenser 500. For example, the housing 520 can be formed of a moldable hard plastic. Suitable hard plastics include polymers and copolymers of ethylene, propylene, butadiene, vinyl compounds and polyesters such as polyethylene terephthalate. The chosen plastic(s), however, should be compatible with the fluid that is to be stored within the dispenser 500 and should not be corroded or degraded by the fluid.

The housing 520 is an elongated hollow tubular structure extending along the longitudinal axis BB. The housing 520 contains the desired fluid or product, which can be any active or inactive oral care agent. The exemplary applicator 530 includes a dispensing orifice (not shown) through which fluid from the housing 520 can be dispensed. The actuator 540 comprises a dome portion 550 and an anti-rotation feature, which in the exemplified embodiment is in the form of two members 560A, 560B that extend axially from the dome portion 550 toward the distal end of the housing 520 and overlie a portion of an outer surface of the housing 520. While FIG. 3 only shows the member 560A on the left side of the dispenser 500, it is understood that a similar member 560B is located on the right side of the dispenser 500. The anti-rotation feature of the rotatable actuator 540 of the dispenser 500 will be described in greater detail below. Moreover, it is to be understood that the rotatable actuator 540 can take on a wide variety of the structural shapes, such as a simple cylinder. In other embodiments, the rotatable actuator 540 can take on the shape of a gear with gear teeth.

In the exemplified embodiment, the actuator 540 is rotatable with respect to the housing 520 and also axially reciprocates along axis B-B during rotation. In addition, the actuator 540 is rotatably coupled to the housing 520. The dispenser 500 includes an internal dispensing subsystem that comprises all necessary components to effectuate the dispensing of the fluid within housing 520 when the rotatable actuator 540 is rotated. While one embodiment of an internal dispensing subsystem is not illustrated, it is to be understood that a wide variety of mechanisms and subsystems can be used to dispense the fluid from the dispenser 500 in accordance with the present invention. The exact structural and functional details of the internal dispensing subsystem are not limiting of the present invention, unless specifically recited in the claims. It is to be understood that the present invention can be incorporated into any dispenser that utilizes a rotatable actuator as the mechanism to dispense the fluid from the dispenser, irrespective of the structural details and/for relative positioning of the rotatable actuator on the dispenser.

Figure 2:
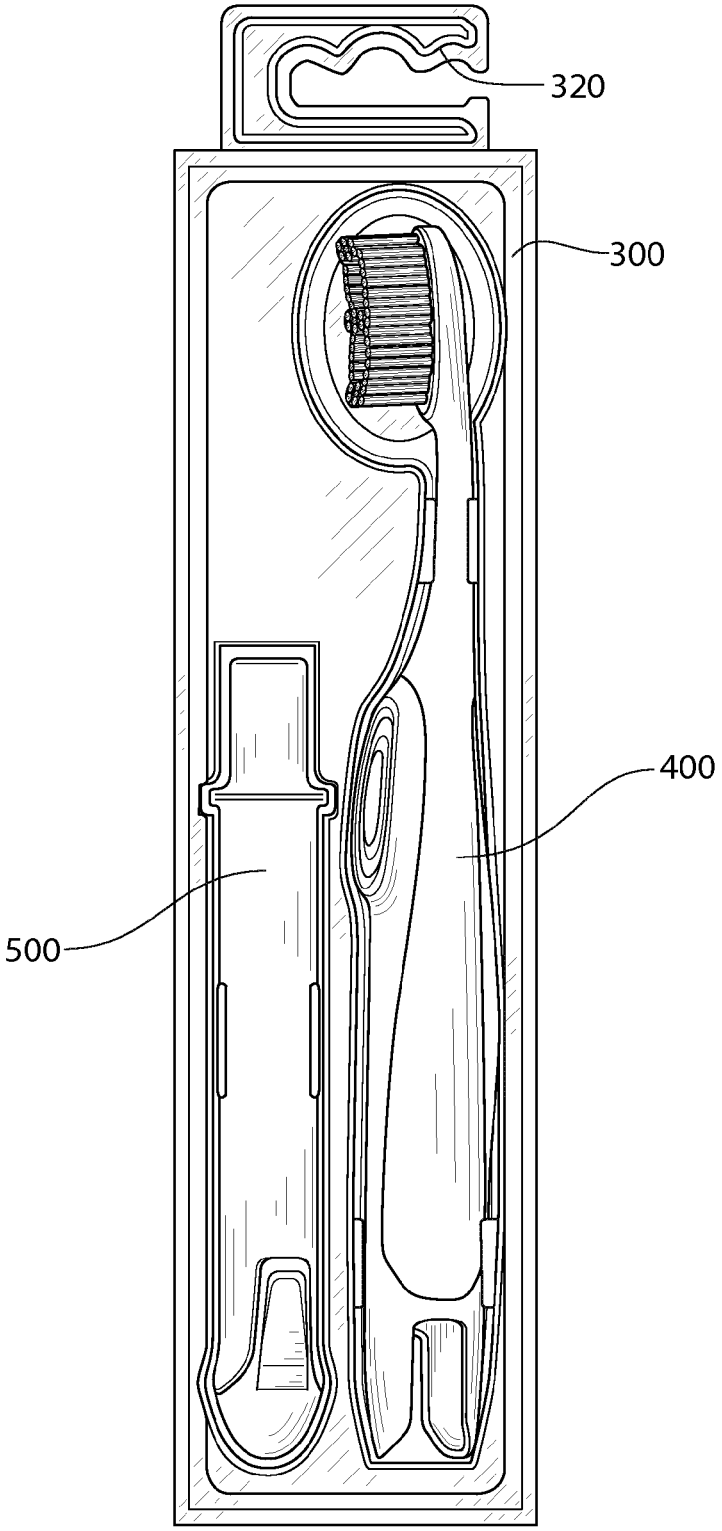
FIG. 2 is a front view of the oral care kit of FIG. 1 without the sleeve.

When the dispenser 500 is in the application state (as illustrated), the rotatable actuator 540 of the dispenser 500 can be rotated to dispense the fluid from the dispenser 500. More specifically, when the dispenser 500 is in the application state, the rotatable actuator 540 of the dispenser 500 can be rotated with respect to the housing 520 to dispense the fluid from the dispenser 500. As a result, the user can use the dispenser 500 to apply the fluid directly to the desired oral surface. However, when the dispenser 500 is in the storage state (as shown in FIG. 1-3), it is desirable that the dispenser 500 be unable to dispense the fluid, which may occur due to inadvertent rotation of the rotatable actuator 540. Thus, as discussed below, the toothbrush 400 and the dispenser 500 are designed so that when the dispenser is in the storage state, the rotatable actuator 540 cannot be rotated in a manner that would inadvertently dispense the fluid from the dispenser 500.

Figure 4:
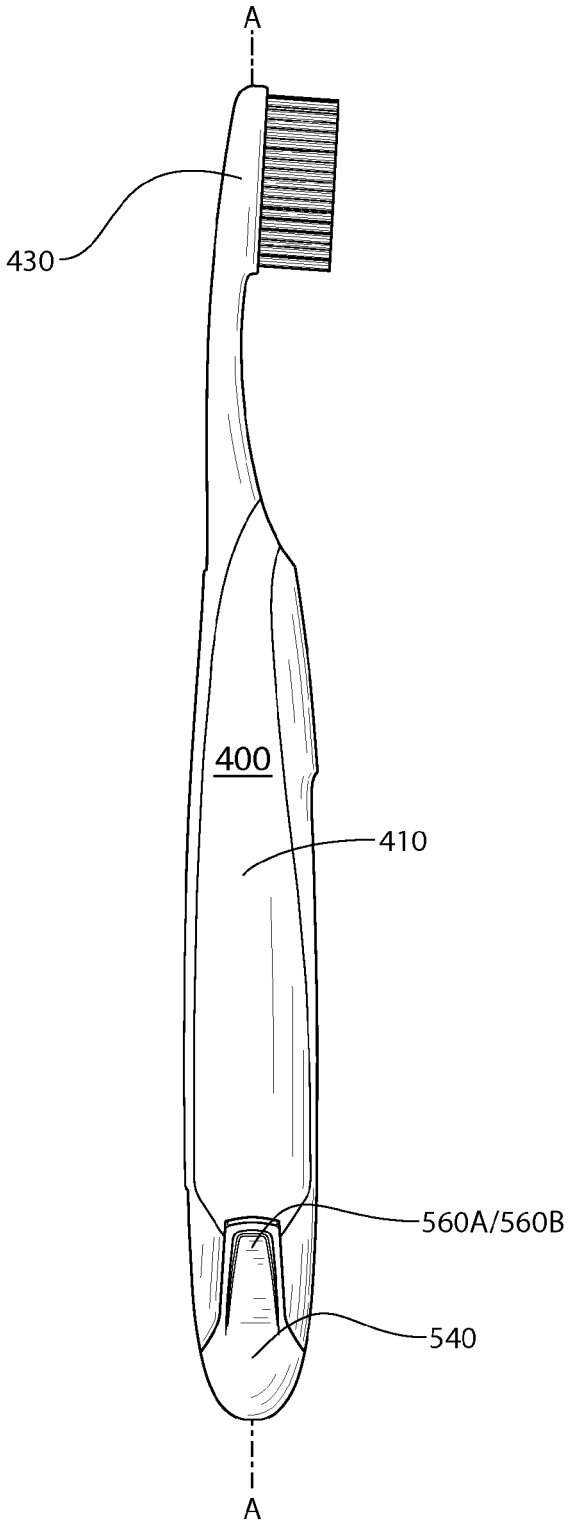
FIG. 4 is the left side view of the toothbrush and the dispenser of the oral care kit of FIG. 1 where the dispenser is stored within a cavity of the toothbrush.

Referring now to FIG. 4, the dispenser 500 is illustrated in the storage state. When in the storage state, the dispenser 500 is docked within the cavity of the handle 410 of the toothbrush 400. An interference fit between an outer surface of the dispenser 500 and an inner surface of the toothbrush 400 facilitates the detachably coupling of the dispenser 500 to the toothbrush 400 within the cavity of the handle 410. When the dispenser 500 is in the storage state, at least a portion, and preferably a majority, of the dispenser 500 is located within the internal cavity of the toothbrush 400.

In the exemplified embodiment, the entirety of the housing 520 of the dispenser 500, including the applicator 530, are located within the cavity of the toothbrush 400 when the dispenser 500 is in the storage state. The rotatable actuator 540 of the dispenser, however, protrudes axially from the proximal end of the handle 410 of the toothbrush 400. In this manner, the rotatable actuator 540 of the dispenser 500 forms a longitudinal extension of the handle 410 of the toothbrush 400. The dome portion 550 of the rotatable actuator 540 continues the natural contour of the handle 410 and provides a rounded proximal end to the oral care kit 100, thereby providing a look that aesthetically resembles a traditional manual toothbrush.

While the housing 520 of the dispenser 500 is located within the cavity of the toothbrush 400 and the rotatable actuator 540 protrudes from the handle 410 of the toothbrush 400, the rotatable actuator 540 cannot be rotated relative to the toothbrush 400 (or relative to the housing 520 of the dispenser 500) due to a mechanical interference created between the anti-rotation feature of the rotatable actuator 540 and the anti-rotation feature of the toothbrush 400. In the exemplified embodiment, the anti-rotation feature of the rotatable actuator 540 comprises the MO members 560A, 560B that extend from the dome portion 550 while the anti-rotation feature of the toothbrush 400 comprises two recesses 450A, 450B that are formed into a proximal edge of the handle 410 of the toothbrush 400. It is understood that in other embodiments, the rotatable actuator 540 can be provided at different location with respect to the toothbrush 400. In such embodiments, different anti-rotation feature will be provided such that the rotatable actuator 540 cannot be rotated relative to the toothbrush 400 (or relative to the housing 520 of the dispenser 500) in the storage state.

As also discussed above, the opening 440 is provided at the proximal end of the handle 410 of the toothbrush 400 that forms a passageway into the cavity. Two recesses 450A, 450B are formed in the proximal edge and provide a geometry in which the members 560A, 560B of the rotatable actuator 540 can nest. When the dispenser 500 is fully inserted into the handle 410 so as to be in the storage state (FIG. 4), the members 560A, 560B of the rotatable actuator 540 slide into and nest within the recesses 450A, 450B of the toothbrush 400 respectively, thereby achieving a mating between the members 560A, 560B of the rotatable actuator 540 and the recesses 450A, 450B of the toothbrush 400 that prohibit the rotatable actuator 540 from being rotated relative to the toothbrush 400. When the dispenser 500 is fully inserted into the handle 410, the rotatable actuator 540 forms a longitudinal extension of the handle 410.

Conceptually, a keyed cooperation is created between the members 560A, 560B of the rotatable actuator 540 and the recesses 450A, 450B of the toothbrush 400 that prohibits relative rotation between the rotatable actuator 540 and the toothbrush 400. In the exemplified embodiment, the members 560A, 560B of the rotatable actuator 540 are the keys while the recesses 450A, 450B of the toothbrush 400 are the corresponding, slots that mate with the keys. As a result of the aforementioned, mechanical interference (or keyed cooperation), the rotatable actuator 540 cannot be inadvertently rotated so as dispense the fluid from the dispenser 500 when the dispenser 500 is in the storage state (i.e., detachably coupled to the toothbrush 400). Moreover, because the housing 520 of the dispenser 500 is located, within the cavity of the toothbrush 400 when the dispenser 500 is in the storage state, the rotatable actuator 540 is also prohibited from rotating relative to the housing 520 of the dispenser 500.

While the exemplified embodiment of the rotatable actuator 540 utilizes two members 560A, 560B to create the mechanical interference (or keyed cooperation) between the rotatable actuator 540 and the toothbrush 400, it is to be understood that in certain other embodiments more or less members (or keys) can be used as desired. For example, in certain embodiments, a single member (or key) can be used that mates with a single recess. In other embodiment, more than two members (or keys) can be used that mate with a corresponding number of recesses.

Figure 5:
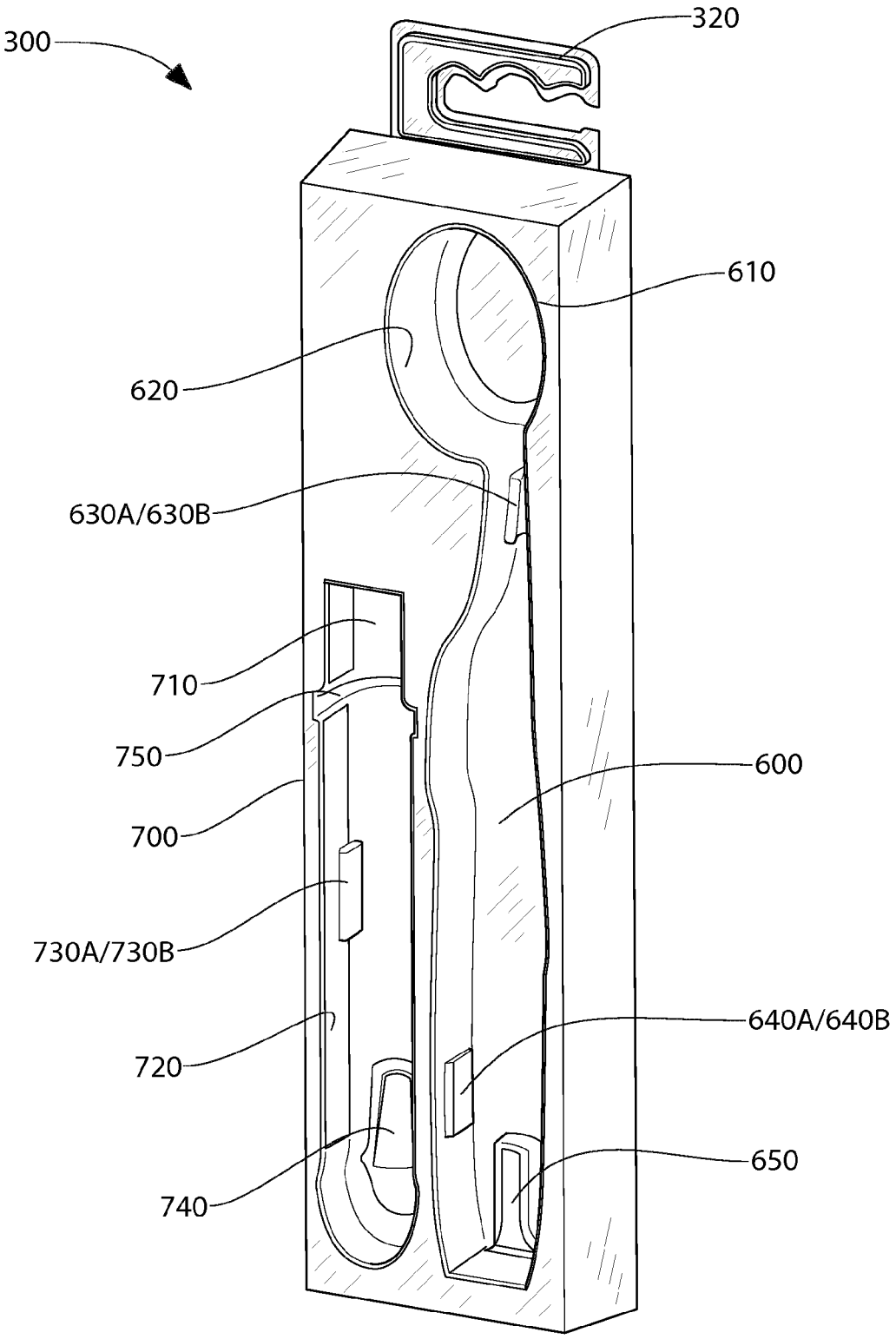
FIG. 5 is a perspective view of the package of the oral care kit of FIG. 1.

Referring now to FIG. 5, the package 300 for containing the toothbrush 400 and the dispenser 500 is illustrated. The package 300 may take on a wide variety of embodiments and may be of a wide variety of packaging types as is known in the an. In one embodiment, the package 300 is a thermoform tray that is formed of thermoformed plastic films. Suitable thermoformed plastic films may be constructed of such material as polyethyleneterephtalate (PETA, PETG, PETGAG), polyvinylchloride (PVC), polypropylene (PP) or styrol-butadiene-blockcopolymer (SBS), preferred polyethyleneterephtalate. Other suitable materials of construction for the thermoformed plastic film include, without limitation, renewable primary products, for example of cornstarch, sugar (polyhydroxybutyrate-valerat), cellulose diacetat, cellulose nitrate, polyactid (PLA), and polyhydroxybutyrat (PHB).

In the embodiment as shown, the package 300 includes a first cavity 600 and a second cavity 700. The first cavity 600 has a shape and size that is capable of receiving the toothbrush 400, and the second cavity 700 has a shape and size that is capable of receiving, the dispenser 500. As shown, the first cavity 600 includes a top surface 610, an inner side surface 620 about the perimeter of the first cavity 600, and a plurality of retaining elements 630-650. In the embodiment as shown, the first cavity 600 includes retaining, elements 630A, 630B for retaining the neck 420, and retaining elements 640A, 640B, 650 for retaining the handle 410. While only one of retaining elements 630A, 630B is shown in the figure, it is understood that a similar retaining elements 630A, 630B is located on an opposing side of the inner side surface 620 around the neck 420. While only one of retaining elements 640A, 640B is shown in the figure, it is understood that a similar retaining elements 640A, 640B is located on an opposing side of the inner side surface 620 around the handle 410. In some embodiments, more or fewer retaining elements may be included where necessary and/or appropriate.

When the toothbrush 400 is placed within the first cavity 600, the neck 420 is secured within the first cavity 600 where a portion of a first side surface of the neck 420 contacts is in surface contacts with one of retaining elements 630A, 630B and a portion of a second side surface of the neck 420 opposing the first side surface of the neck 420 contacts the other one of the retaining elements 630A, 630B. In addition, when the toothbrush 400 is placed within the first cavity 600, the handle 410 is secured within the first cavity 600 where a portion of a first side surface of the handle 410 contacts (i.e., is in surface contact with) one of retaining elements 640A, 640B and a portion of a second side surface of the handle 410 opposing the first side surface of the handle 410 contacts the other one of the retaining elements 640A, 640B. Further, when the toothbrush 400 in placed within the first cavity 600, an inner perimeter of each of the recesses 450A and 450B is hi surface contact with an outer perimeter of the retaining element 650.

In the embodiment as shown, the retaining elements 630A, 630B, 640A, 640B are in the form of a rectangular protrusion that extends from the inner side surface 620 inward and towards an interior of the first cavity 600. Also as shown, the retaining element 650 is in the form of a trapezoidal protrusion that extends from the top surface 610 upward and away from the top surface 610. Further as shown, the retaining elements 630A. 630B, 640A, 640B, 650 help to orient the toothbrush 400 within the first cavity 600 such that (1) the front and rear surfaces of the head 430 of the toothbrush 400 are at an oblique angle relative to the top surface 610 of the first cavity 600, and (2) the opening 440 is clearly visible to a consumer at the point of purchase. The angle is formed between an orthogonal axis passing through the front and rear surfaces of the head 430 and a horizontal axis extending across the top surface 610 near the head 430. In seine embodiments, that angle may be between 5° to 80°. In some embodiments, that angle may be between 20° to 40°. It is understood that the shape of the retaining elements 630A, 630B, 640A, 640B, 650 may be different in other embodiments. It is also understood that the location of the retaining elements 630A, 630B, 640A, 640B, 650 may be different in other embodiments.

With continuing reference to FIG. 5, the second cavity 700 includes a top surface 710, an inner side surface 720 about the perimeter of the second cavity 700, and a plurality of retaining elements and channels 730-750, in the embodiment as shown, the second cavity 700 includes retaining elements 730A, 730B for retaining the housing 520, a first retaining channel 740 for retaining the rotatable actuator 540, and a second retaining channel 750 for retaining the cap 510 of the dispenser 500. While only one of retaining elements 730A, 730B is shown in the figure, it is understood that a similar retaining elements 730A, 730B is located on an opposing side of the inner side surface 720 around the housing 520. In some embodiments, more or fewer retaining elements and/or channels may be included where necessary and/or appropriate.

When the dispenser 500 is placed within the second cavity 700, the housing 520 is secured within the second cavity 700 where a portion of a first side surface of the housing 520 contacts (i.e., is in surface contact with) one of retaining elements 730A, 730B and a portion of a second side surface of the housing 520 opposing the first side surface of the housing 520 contacts the other one of the retaining elements 730A, 730B. In addition, when the dispenser 500 is placed within the second cavity 700, the rotatable actuator 540 is secured within the second cavity 700 where one of the two anti-rotation members 560A, 500B is in surface contact with the first retaining channel 740. Further, when the dispenser 500 in placed within the second cavity 700, a rim of the cap 510 is in surface contact with the retaining element 750.

In the embodiment as shown, the retaining elements 730A, 730B are in the form of a rectangular protrusion that extends from the inner side surface 720 inward and towards an interior of the second cavity 700. Also as shown, the retaining, channels 740, 750 are in the form of a depression and/or groove that are formed into the second cavity 700 of the package 300. The shape of the retaining channel 740 corresponds substantially to the shape of the anti-rotation members 560A, 560B, and the shape of the retaining channel 750 corresponds to the shape of the rim of the cap 510. As shown, when the dispenser 500 is placed within the package 300, the cap 510 is coupled to the applicator 530 so as to prevent damages to the applicator 530. It is understood that the shape of the retaining elements and channels 730A, 730B, 740, 750 may be different in other embodiments. It is also understood that the location of the retaining elements and channels 730A, 730B, 740, 750 may be different in other embodiments. For example, in an alternative embodiment, the retaining channel 740 may be eliminated and a pair of retaining elements may be included around an upper portion of the cap 510. In another alternative embodiment, the retaining elements 730A, 730B may be eliminated.

Figure 6:
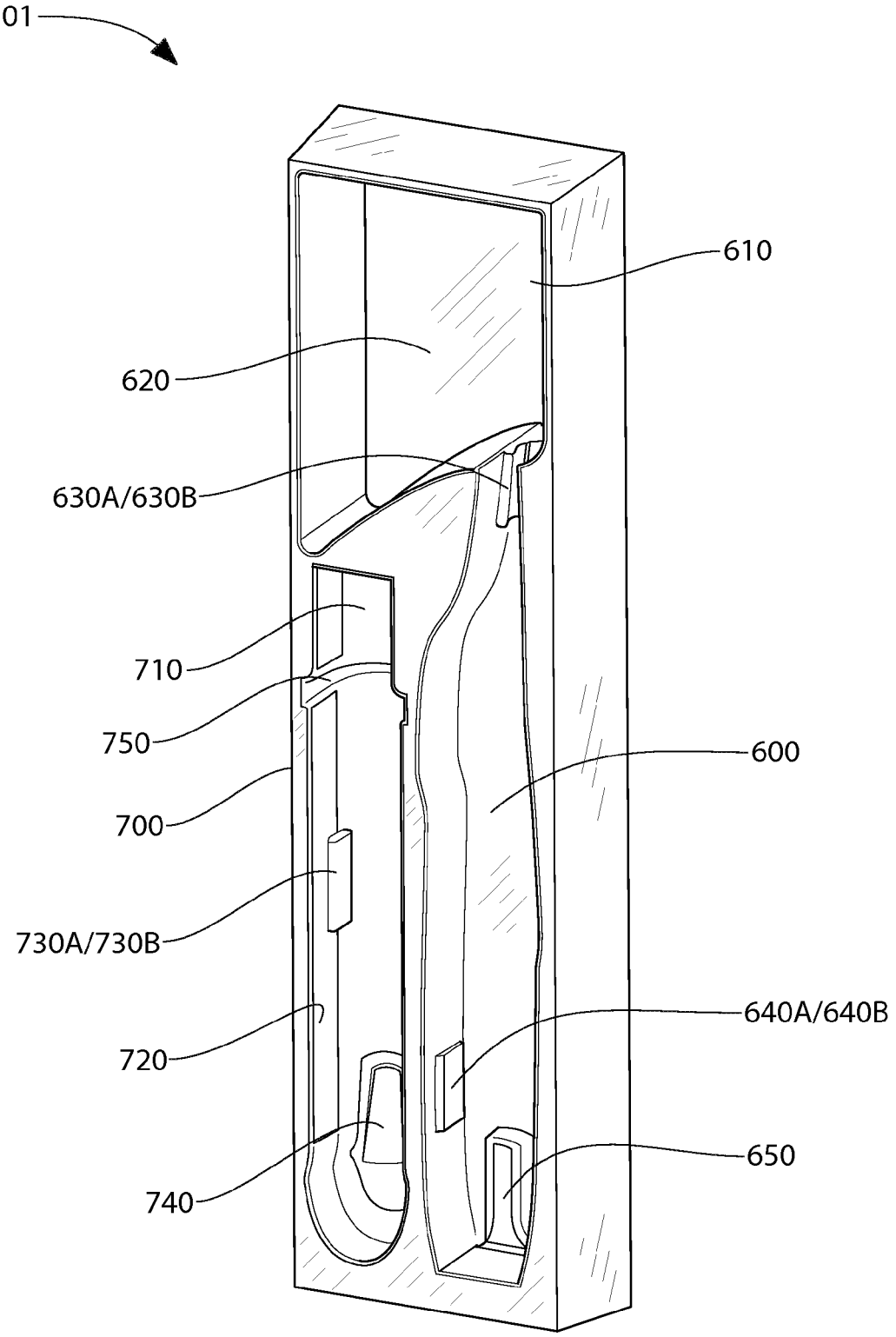
FIG. 6 is a perspective view of a package of an oral care kit according to another embodiment of the present invention.

Referring to FIG. 6, an alternative embodiment of the package is illustrated. The package 301 includes similar components as the package of 300 of FIG. 5. The same reference numerals are given to the corresponding features between the package 301 and the package 300. For example, the package 301 similarly includes a first cavity 600 for receiving the toothbrush 400 and a second cavity 700 for receiving the dispenser 500 and the various retaining elements and channels. However, the packages 300 and 301 differ in the construction of a portion of the first cavity 600 where the head 430 of the toothbrush 400 may be disposed. Specifically, that portion spans approximately half the width of the package 300, but spans more than half the width of the package 301.

Referring back to FIGS. 1 and 2 concurrently, the oral care kit 100 will be further described in its assembled state. When the oral, care kit 100 is assembled, the toothbrush 400 and the dispenser 500 are positioned within the first cavity 600 and the second cavity 700 respectively. As described above, each of the first cavity 600 and the second cavity 700 include retaining elements to properly orient the toothbrush 400 and the dispenser 500. Specifically, the retaining elements of first cavity 600 cooperate so that the toothbrush 400 is mounted within the cavity 600 such that the front and rear surfaces of the head 430 of the toothbrush 400 are at an oblique angle relative to the top surface 610 of the first cavity 600. In addition, by positioning the toothbrush 400 at an oblique angle, the tooth engaging elements become more visible to a consumer.

In the exemplified embodiment, such visibility allows a potential customer to clearly and adequately inspect/view the toothbrush 400 and the dispenser 500 individually. At, the same tune, the potential customer is allowed to view the anti-rotation features 450A, 450B, 560A, 560B clearly at the point of sale. Because of the correspondence between the shapes of the anti-rotation features 450A. 450B, 560A, 560B, the potential customer can understand that the toothbrush 400 and the dispenser 500 can be used together and how the two products will be assembled together without opening the oral care kit 100.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing, from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in ail respects as illustrative and not restrictive, the scope of the invention being defined by the appended claims, and not limited to the forgoing description or embodiments.

What is claimed is:

1. An oral care kit comprising:

a package comprising a first cavity including a first plurality of retaining elements and a second cavity including a second plurality of retaining elements and a first retaining channel, the first cavity including a top surface;

a toothbrush comprising a head, a handle, and a recess located at a proximal end of the handle, the toothbrush positioned within the first cavity, a portion of the toothbrush contacting the first plurality of retaining elements;

a dispenser comprising a housing, a rotatable actuator located at a proximal end of the housing and a first anti-rotation member and a second anti-rotation member located at the proximal end of the housing, the first anti-rotation member located on a left side of the dispenser and the second anti-rotation member located on a right side of the dispenser, the dispenser positioned within the second cavity, a first portion of the dispenser contacting the second plurality of retaining elements and a second portion of the dispenser and the first anti-rotation member contacting the first retaining channel, the first retaining channel corresponding substantially to the shape of the first anti-rotation member; and wherein the toothbrush is mounted within the first cavity so that the recess is visible from outside of the package and the dispenser is mounted within the second cavity so that the second anti-rotation member is visible from outside of the package so as to provide visual cues as to how the toothbrush and the dispenser are to be assembled together.

2. The oral care kit according to claim 1 wherein the first cavity has a shape and size that corresponds to a shape and size of the toothbrush.

3. The oral care kit according to claim 1 wherein the toothbrush further comprises an opening located at the proximal end of the handle.

4. The oral care kit according to claim 3 wherein one of the first plurality of retaining elements comprises a protrusion extending from the top surface, the protrusion has a shape and size that corresponds to a shape and size of the recess.

5. The oral care kit according to claim 4 wherein when the toothbrush is positioned within the first cavity, an outer perimeter of the protrusion is in surface contact with an inner perimeter of the recess.

6. The oral care kit according to claim 3 wherein one of the first plurality of retaining elements comprises a protrusion extending from an inner side surface of the first cavity, and wherein when the toothbrush is positioned within the first cavity, a portion of toothbrush contacts the protrusion.

7. The oral care kit according to claim 6 wherein the portion of toothbrush that contacts the protrusion is a portion of a neck of the toothbrush or a portion of the handle of the toothbrush.

8. The oral care kit according to claim 1 wherein the toothbrush further comprising an additional recess located at the proximal end of the handle, and wherein one of the first plurality of retaining elements comprises a protrusion extending from the top surface, the protrusion has a shape and size that corresponds to a shape and size of the recesses, and when the toothbrush is positioned within the first cavity, an outer perimeter of the protrusion is in surface contact with an inner perimeter of each of the recesses.

9. The oral care kit according to claim 3 wherein the opening forms a passageway into the toothbrush through which a portion of the dispenser can be slid, and the rotatable actuator forms a longitudinal extension of the handle.

10. The oral care kit according to claim 1 wherein the second cavity has a shape and size that corresponds to a shape and size of the dispenser.

11. The oral care kit according to claim 1 wherein the dispenser further comprises a cap having a rim and the package further comprises a second retaining channel, and when the dispenser is positioned within the second cavity, a portion of an outer perimeter of the rim is in surface contact with an inner perimeter of the second retaining channel.

12. The oral care kit according to claim 1 wherein one of the second plurality of retaining elements comprises a protrusion extending from an inner side surface of the second cavity, and wherein when the dispenser is positioned within the second cavity, a portion of the dispenser contacts the protrusion.

13. The oral care kit according to claim 12 wherein the portion of the dispenser that contacts the protrusion is a portion of the housing of the dispenser.

14. The oral care kit according to claim 1 wherein the toothbrush is mounted within the first cavity so that a front surface and a rear surface of the head of the toothbrush are at an oblique angle relative to the top surface of the first cavity.

15. The oral care kit according to claim 14 wherein the oblique angle is between 5° to 80°.

16. The oral care kit according to claim 14 wherein the oblique angle is between 20° to 40°.

17. The oral care kit according to claim 1 further comprising a sleeve wrapped around the package, the sleeve being substantially transparent such that the toothbrush and dispenser are visible.

18. A package for an oral care kit comprising:

a first cavity including a top surface and an inner side surface, a first plurality of retaining elements extending from the inner side surface and the top surface, the first cavity has a shape and size that corresponds to a shape and size of a toothbrush; and a second cavity including a top surface and an inner side surface, a second plurality of retaining elements extending from the inner side surface and a first retaining channel disposed in the top surface, the second cavity has a shape and size that corresponds to a shape and size of a dispenser that comprises a first anti-rotation member and a second anti-rotation member, the first anti-rotation member located on a left side of the dispenser and the second anti-rotation member located on a right side of the dispenser;

wherein when the toothbrush is mounted within the first cavity, the first plurality of retaining elements cooperate to orient the toothbrush so that a recess of the toothbrush is visible, and when the dispenser is mounted within the second cavity, the first anti-rotation member is in contact with the first retaining channel, and the second plurality of retaining elements and the first retaining channel cooperate to orient the dispenser so that the second anti-rotation member is visible from outside the package so as to provide visual cues as to how the toothbrush and the dispenser are to be assembled together, the recess and the anti-rotation member capable of forming a keyed cooperation.

19. The package according to claim 18 wherein when the toothbrush is positioned within the first cavity, an outer perimeter of a protrusion is in surface contact with an inner perimeter of the recess.

* * * * *